United States Patent [19]

Gailus et al.

[11] 4,079,668

[45] Mar. 21, 1978

[54] PRESS

[75] Inventors: Walter J. Gailus, Chicago; Jayadev P. Patel, Bolingbrook, both of Ill.

[73] Assignee: Continental Can Company, Inc., New York, N.Y.

[21] Appl. No.: 647,691

[22] Filed: Jan. 9, 1976

[51] Int. Cl.[2] ..... B30B 1/26; B30B 15/04

[52] U.S. Cl. ..... 100/214; 72/465; 100/208; 100/268; 100/292

[58] Field of Search ..... 83/632, 859, 628, 617; 192/105; 74/581, 582; 425/151; 72/450, 466, 465, 431, 433, 434; 267/162; 100/53, 208, 268, 292, 237, 214, 231, 260, 282

[56] References Cited

U.S. PATENT DOCUMENTS

| | | | |
|---|---|---|---|
| 2,522,450 | 9/1950 | Johansen | 100/53 X |
| 2,616,543 | 11/1952 | Danly | 192/150 |
| 2,667,248 | 1/1954 | Wissmann | 100/282 X |
| 2,937,734 | 5/1960 | Sommer | 192/150 |
| 3,160,089 | 12/1964 | Platou | 100/53 X |

*Primary Examiner*—Billy J. Wilhite
*Attorney, Agent, or Firm*—John J. Kowalik; Joseph E. Kerwin; William A. Dittman

[57] ABSTRACT

A simplified heavy-duty press having a bed and a support head mounted from the press bed for limited vertical movement under predetermined spring preload. The entire drive (less motor) and rams are carried from the press head and these components are movable away from the bed when the tools between the ram and bed encounter an obstruction beyond the preload. The preload limits maximum operative force that will be transmitted in the mechanisms where precise control of the components/dimensions may be difficult to maintain because of manufacturing limitations or because of thermal expansion.

6 Claims, 7 Drawing Figures

PRESS

DISCUSSION OF THE PRIOR ART

Reference is made to a companion U.S. Application, entitled "Pre-Loading and Energy Absorbing System" filed in the names of Walter J. Gailus, Jayadev P. Patel and Robert Lam, Ser. No. 647,692 filed on Jan. 9, 1976 now U.S. Pat. No. 4,026,207.

Heavy duty presses conventionally incorporate a C-frame casting, the lower portion of which provides the bed and the upper portion comprises the ram carrying head, the head being rigidly connected to the bed by intervening rigid structure which is part of the casting. As presently known to applicants, no provisions have been heretofore made to accommodate overloads that develop between the tools upon the introduction of foreign object therebetween or because of thermal expansion by permitting the head and bed to separate.

Kiss-blocks are normally employed to govern the closure of the die parts. Due to thermal expansion, inordinate loads are imposed on these blocks and transmitted to the operating components. The frame being exceptionally strong accepts such overloads and damage is therefore transmitted to the drive, the bearings, the tools or the ram components.

SUMMARY OF THE INVENTION

This invention is directed to a novel press in which the drive (less motor) and ram parts are carried by a head held in relation to the bed of the press under a preload not yieldable within the working range of the press, but which is yieldable to accommodate overloads without destroying the working parts.

The invention comprehends a novel press comprising a bed and a head, the latter being supported above the bed on a plurality of columns which have preloaded takeup connections with the head and bed permitting relative separation therebetween.

The invention contemplates a novel press wherein the columns between the head and bed have shoulders limiting advance of the head toward the press, but which within pre-established maximum excursion, do not inhibit separation therebetween.

The invention also comprehends the provision of spring means preferably in the form of Belleville washers which bias the bed and columns into engaged position under a predetermined preload.

The invention is also directed to a novel simplified press wherein there are provided between the head and bed a series of vertical columns which not only serve as connectors but, also, as guides for the upper tool supporting platens which are arranged in a novel rigidifying and alignment-maintaining triangular arrangement incorporating a three point mounting of a pair of upper platen portions for plural lane operation, each platen sliding on a pair of outer vertical posts and an inner vertical post, the inner edge portions of the platens confronting each other along diagonal facings and overlapping each other fore and aft of the press whereby the slide areas of the respective platen portions are spaced at optimum distances apart to obtain durable accurate mountings which are thermally and dynamically stable.

These and other objects and advantages inherent in and encompassed by the invention will become more readily apparent from the specification and the drawings, wherein.

DESCRIPTION OF THE INVENTION

Figure 1:
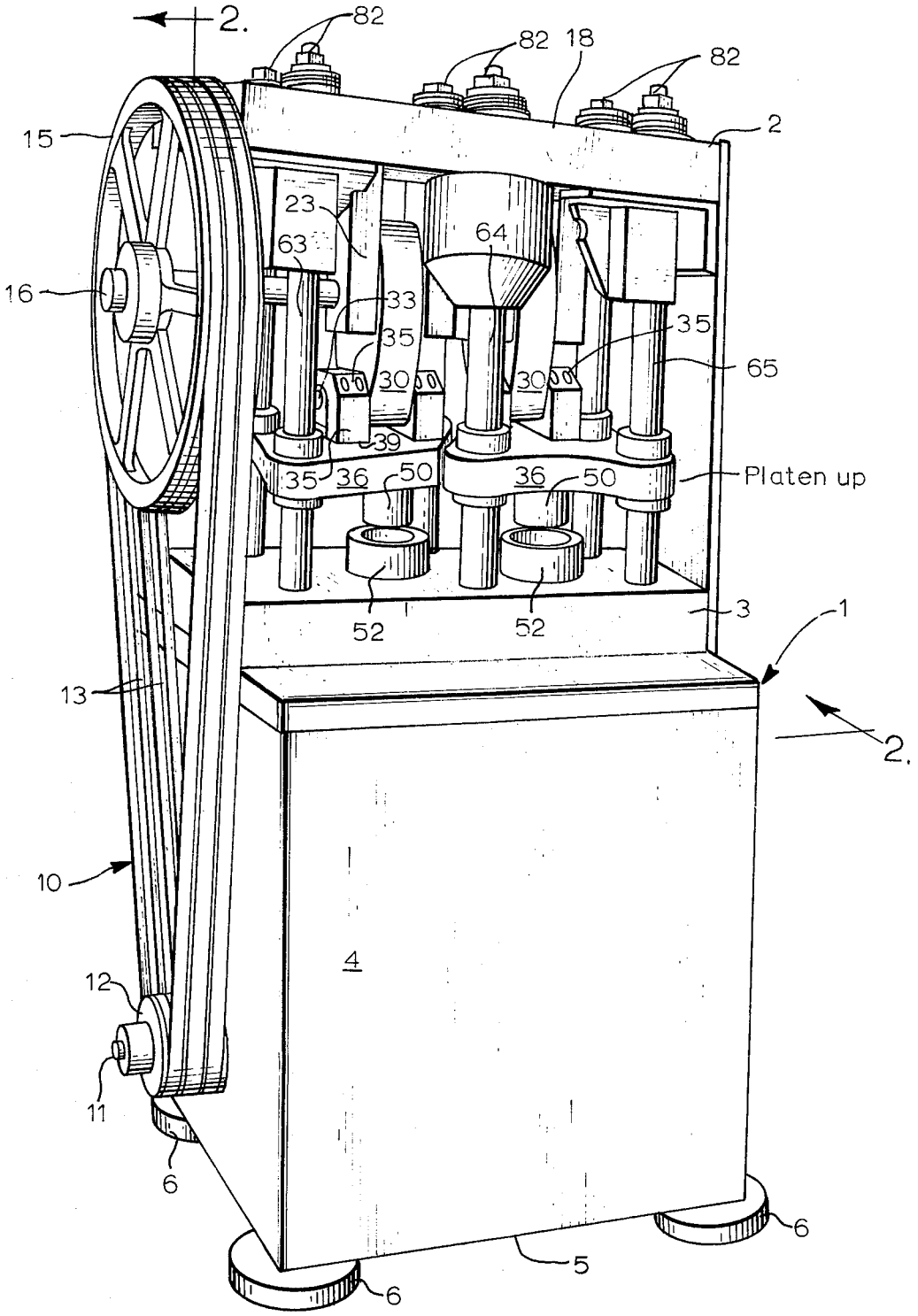
FIG. 1 is a perspective front side elevational view of the novel press.

The press generally designated 1 comprises a floating head generally indicated 2 and a stationary bed or anvil 3 and a support frame 4 which has a base 5 with usual feet 6 for leveling the press upon a floor or other appropriate foundation.

The press drive means generally designated 10 comprises a motor driven output shaft 11 which is suitably journaled from the frame adjacent to its base, the shaft 11 being connected to a multiple pulley 12 about which are entrained a plurality of drive belts 13. The belts 13 are wrapped about a multiple pulley 15 which is connected to an input crank shaft 16.

The shaft 16 is carried solely from the press head platen 18 and is journaled in bearings 19 and 20 which are mounted in split block and cap assemblies 22,22, the block portions 23 of which depend from top plate 18 of the press head and are suitably secured thereto whilst the caps 25 are secured by bolts 26 to the respective block portions 23. The shaft 16 is provided with two axially aligned throws 27,27 each of which has a rotary connection via bearings 28 to one end of a load transfer mechanism in the form of a ram or arm 30 which at its other or lower end is rotatably connected through bearings 31 to a pin 33 which at each end is journaled in bushed bearings 34 (FIGS. 2 and 5) provided in mounting blocks 35,35 which are secured to the top side of a horizontally disposed tool mounting platen 36 for movement therewith.

Each block 35 comprises a U-shaped cap 37 with an inverted U-shaped slot therein within which there is fitted the complimentary bearing insert 34 which at its lower end 39 seats upon the platen 36. The caps 37 are drawn down onto the bearing insert by bolts 47' extending through openings 48 in the cap and threaded into apertures 49 in the upper platen until a predetermined torque is established. The upper platen 36 operates an upper tool 50, which is fastened to the underside of the top platen, against a lower tool 52 which is fastened to the immovable or rigid bed or base anvil 3.

Figure 3:
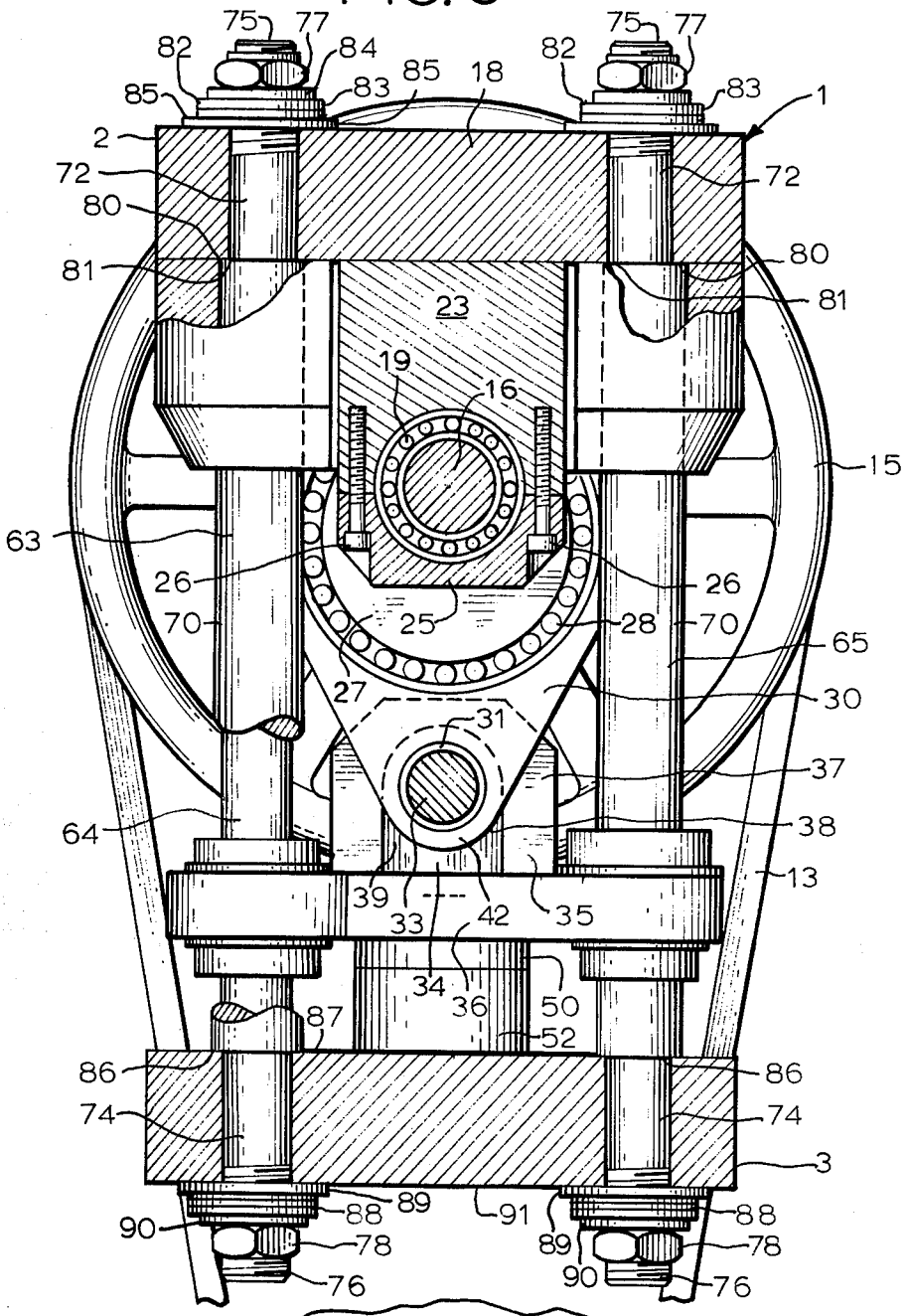
FIG. 3 is a vertical sectional view taken substantially on line 3—3 of FIG. 2.
Figure 7:
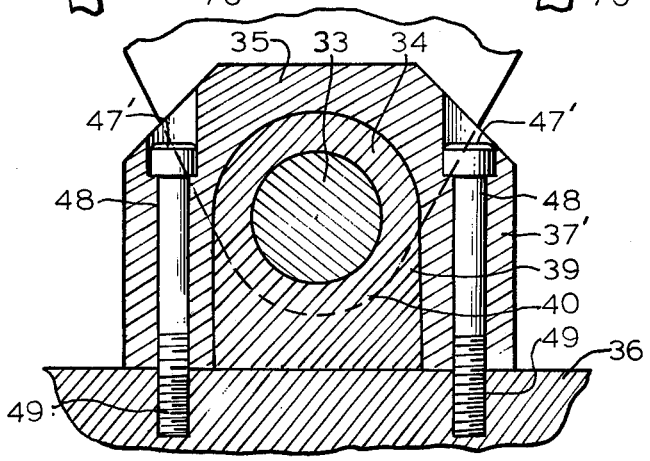
FIG. 7 is an enlarged sectional view taken substantially on line 7—7 of FIG. 2.
Figure 4:
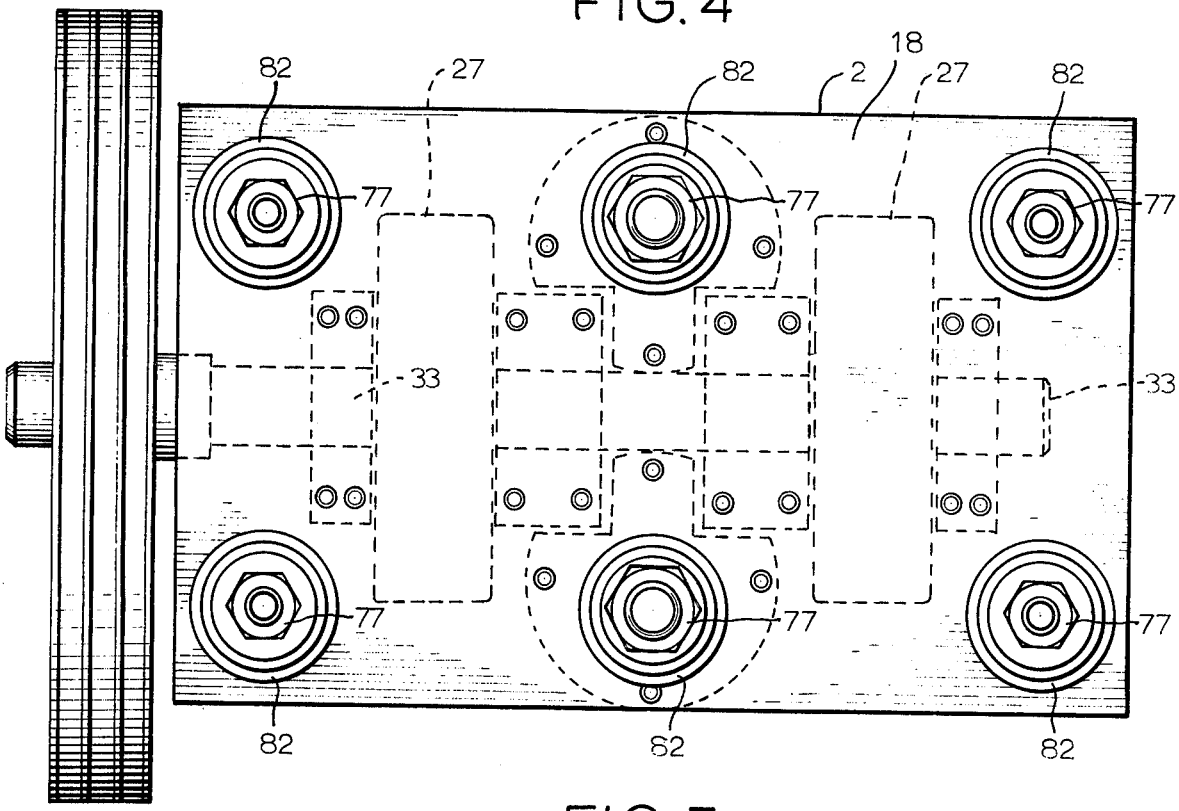
FIG. 4 is a top plan view taken substantially on line 4—4 of FIG. 2.
Figure 5:
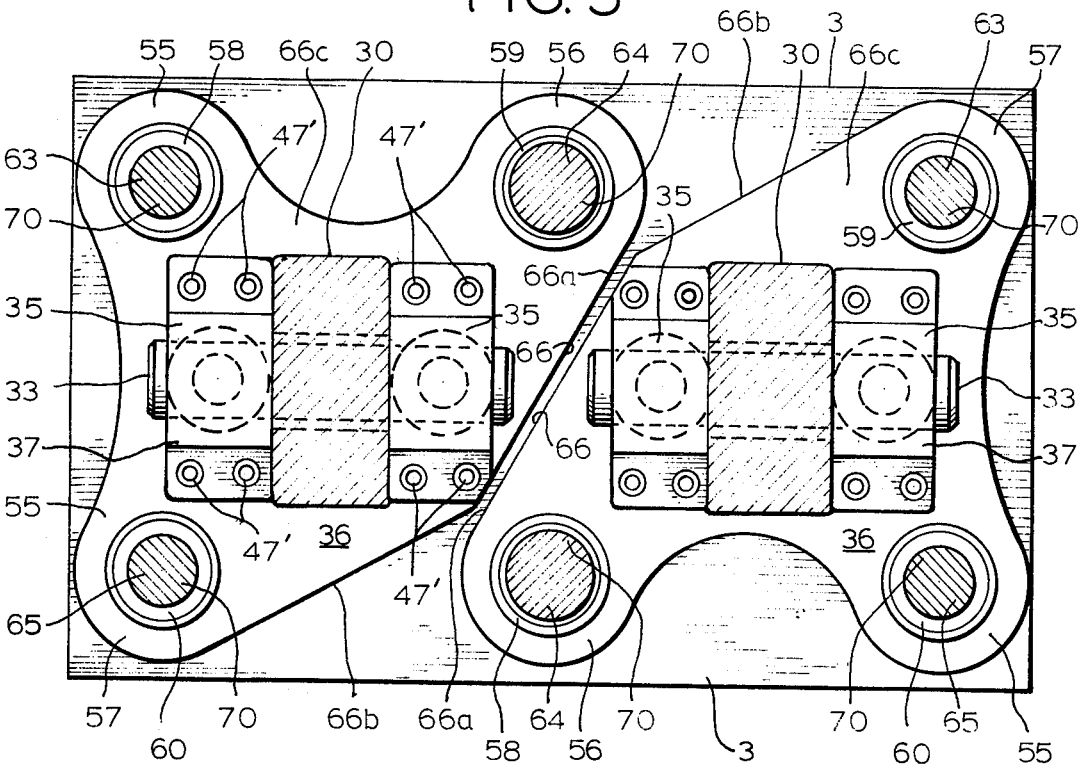
FIG. 5 is a horizontal sectional view taken substantially on line 5—5 of FIG. 2.

As best seen in FIGS. 3 and 5, each platen 36 is somewhat triangular shaped in top plan and comprises three corner lugs 55,56,57 which are respectively provided with bushings or slide bearings 58,59, and 60 sleeved over vertical guide and tie rods 63,64 and 65. The platens are dovetailed and oppose each other along their hypotenusal edges 66,66 (FIG. 5) which are formed with converging portions **66*a* and 66*b* to provide sufficient width in their central portions 66*c*** to accommodate the mounting and connecting structure between the drive arm and the bearing blocks and the tooling therebeneath.

It will be noted that by this construction each platen rides up and down on only three rods and that each platen is guided at its inner edge by a vertical rod 64 spaced laterally from the rods 63,65 at the ends of the platens. Thus, the loading on the press bed and press head at opposite sides of the press center line is generally equalized and canting loads on the floating press head are essentially eliminated.

Figure 2:
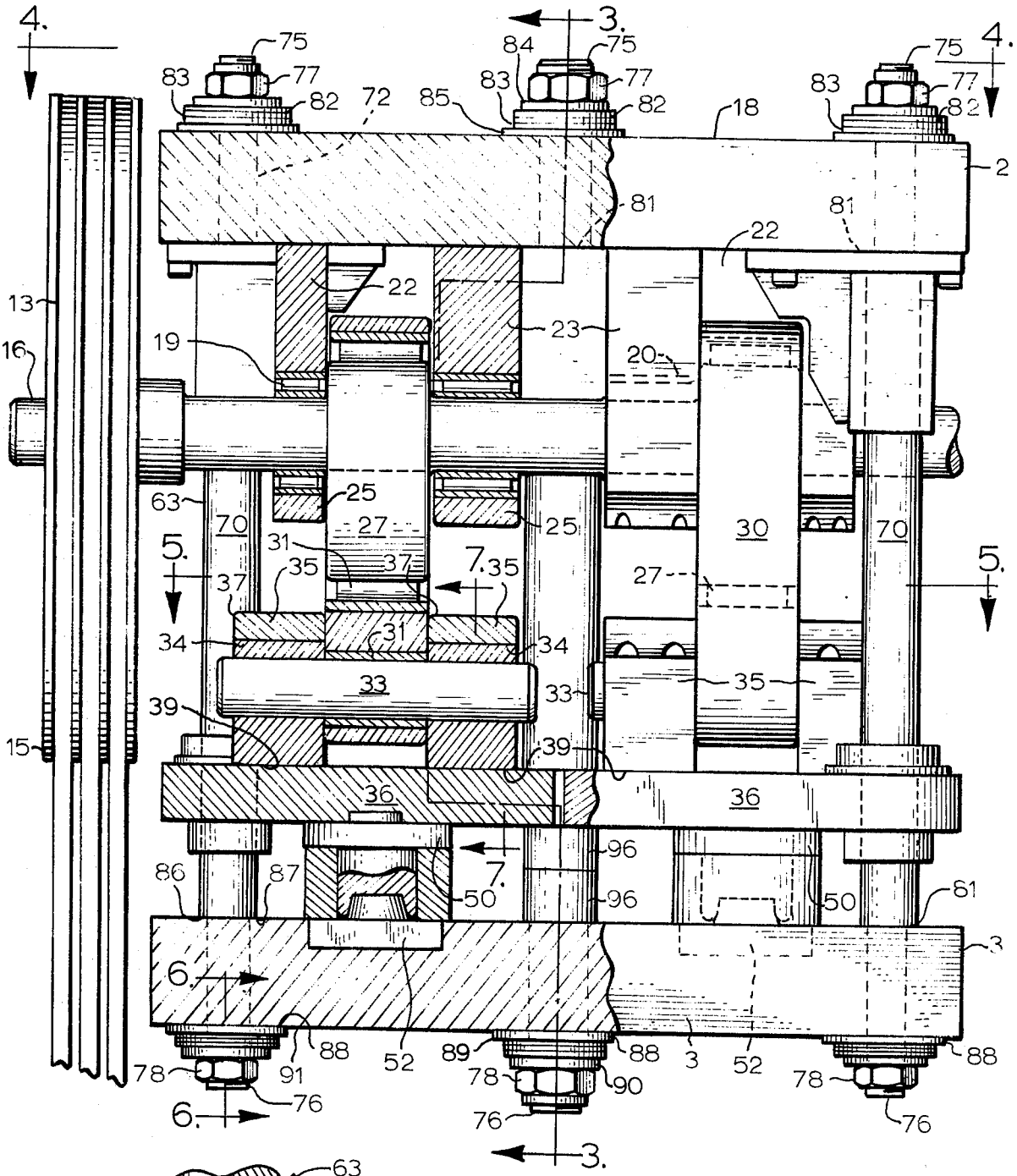
FIG. 2 is an enlarged vertical sectional view of the press bed and head taken substantially on line 2—2 of FIG. 1.
Figure 6:
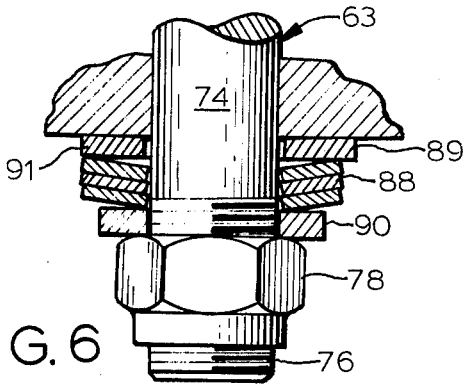
FIG. 6 is an enlarged sectional view taken substantially on line 6—6 of FIG. 2.

A feature of the invention is in providing prestressed or preloaded connections between the tie rods and the floating press head and between the tie rods and the press bed. As best seen in FIG. 2, each rod 63,64 and 65 comprises a cylindrical center section 70 and upper and lower reduced end portions 72,74 which are threaded at their outer ends as at 75 and 76, respectively, and on which there are threaded nuts 77,78. Each lower end portion 72 terminates at a shoulder 80 (FIG. 3) which abuts at 81 against the underside of the press head plate 18, the shoulder being drawn up by a biasing means 82 in the form of a stack of Belleville washers 83,83 which are sleeved on the reduced portions 72 between upper and lower flat washers 84,85 which seat, respectively, against the top side of the press head and the bottom side of the respective nut 77. Similarly, the lower shoulders 86 on the rods engage the upper face 87 of the press bed and are urged into contact therewith by a preloaded Belleville spring stack 88 which with top and bottom washers 89,90 is sleeved onto the lower reduced ends of respective rods and interposed between the bottom side 91 of the press bed and the respective lower nuts 78. Each spring as well known to those skilled in the art is a cup shaped steel spring disc and all of the discs are disposed in cupped relation to each other. It will be understood that the spring means (Belleville springs) may be located only at the top or bottom or in both locations.

As best seen in FIG. 2, each platen carries an upper tool element 50 on its lower side which mates with a lower tool element 52 mounted on the stationary press-bed platen and the material is fed between these elements. As part of tooling sub-system, there are normally provided kiss-blocks 96,96 between the upper and lower platens and attached thereto to limit advancing movements between upper and lower tool movement. Upon the occurrene of a malfunction or because of excessive thermal expansion, misadjustment of the tooling or the malfunction of a part, etc., large increase in the force between the tool elements or kiss-block will occur. Upon such occurrence, the initial relief will occur in the compression of the springs between the respective load transfer arms and the associated platen and, if this is transcended, then the press head will lift up compressing the springs between the tie rods and the upper and lower or head and bed portions of the press.

It will be understood that a best mode of utilization presently known to applicants has been disclosed; however, various other embodiments of the invention will now become readily apparent to those skilled in the art within the scope of the appended claims.

What is claimed is:

1. A press having a floating head portion and a bed portion, means interconnecting said portions for separating and advancing movement relative to each other and including preloaded means for lmiting said separating movements to predetermined overload conditions developed between said portions, drive means supported on one of said portions, load transfer means mounted on one of said portions in driven relation by said drive means, and tool mounting means on each said portion, tooling carried by said mounting means for operating on articles to be placed therebetween with attendant application of force through said tooling to the articles, and said preload means located at the vertical center plane of the press and at opposite sides thereof effective to yield beyond predetermined loading parameters required for forming the articles to accommodate stress loads transcending said parameters, and guide means for each of said tool mounting means extending between said head portion and said bed portion and slidably supporting the respective tool mounting means along three parallel axes, said tool mounting means being disposed in side by side relation and each having an inner end portion dovetailed with a corresponding portion of the other tool mounting means to provide wide span supports therefor.

2. A press according to claim 1 wherein said drive means and load transfer means is carried by the floating head portion.

3. The invention according to claim 1 and said interconnecting means comprising a plurality of tie rods having a lost motion connection with at least said head portion, and said yieldable means comprising spring means having a deflection rate compatible with the loading parameters.

4. The invention according to claim 1 and said dovetailed inner end portions comprising diagonal edges opposing each other and overlapping each other in generally horizontal planes.

5. A press having a floating head portion and a bed portion, means interconnecting said portions for separating and advancing movement relative to each other and including preloaded means for limiting said separating movement to predetermined overload conditions developed between said portions, drive means supported on one of said portions, load transfer means mounted on one of said portions in driven relation by said drive means, and tooling disposed between said portions for operating on articles to be placed therebetween with attendant application of force through said tooling to the articles, and said preload means located at the vertical center plane of the press and at opposite sides of the press effective to yield beyond predetermined loading parameters required for forming the articles to accommodate stress loads transcending said parameters, and said drive means having first and second sections mounted in respective portions and comprising a stretchable belt drive interconnecting said sections to accommodate said separating movements.

6. A press having a floating head portion and a bed portion, means interconnecting said portions for separating and advancing movement relative to each other and including preloaded means for limiting said separating movements to predetermined overload conditions developed between said portions, drive means supported on one of said portions, load transfer means mounted on one of said portions in driven relation by said drive means, and tool mounting means on each said portion, tooling disposed carried on said tool mounting means between said portions of the press for operating on articles to be placed therebetween with attendant application of force through said tooling to the articles, and said preload means located at the vertical center plane of the press and at opposite sides of the press effective to yield beyond predetermined loading parameters required for forming the articles to accommodate stress loads transcending said parameters, and auxiliary preloaded release means between said tooling and at least one of said tool mounting means.

* * * * *